US006783050B2

(12) United States Patent
Ishizawa et al.

(10) Patent No.: US 6,783,050 B2
(45) Date of Patent: Aug. 31, 2004

(54) NAIL GUN PROVIDED WITH DUSTER FUNCTION

(75) Inventors: Yoshinori Ishizawa, Hitachinaka (JP); Yoshihiro Nakano, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/446,790

(22) Filed: May 29, 2003

(65) Prior Publication Data

US 2004/0026477 A1 Feb. 12, 2004

(30) Foreign Application Priority Data

May 31, 2002 (JP) ..... P2002-160100
May 31, 2002 (JP) ..... P2002-160101

(51) Int. Cl.[7] ..... B25C 1/04
(52) U.S. Cl. ..... 227/130; 227/156
(58) Field of Search ..... 227/130, 10, 156, 227/112; 123/46 SC

(56) References Cited

U.S. PATENT DOCUMENTS 3,905,535 A * 9/1975 Novak et al. ..... 227/120
4,039,113 A * 8/1977 Males ..... 227/130
4,384,668 A * 5/1983 Tutomu et al. ..... 227/8
4,736,879 A * 4/1988 Yamada et al. ..... 227/130
5,259,465 A * 11/1993 Mukoyama ..... 173/168
5,715,986 A * 2/1998 Sauer ..... 227/130
5,829,660 A * 11/1998 White ..... 227/8
5,850,961 A * 12/1998 Braun et al. ..... 227/130
5,878,936 A * 3/1999 Adachi et al. ..... 227/130
5,918,788 A * 7/1999 Moorman et al. ..... 227/8
6,572,000 B2 * 6/2003 Hirai et al. ..... 227/130

* cited by examiner

*Primary Examiner*—Scott A. Smith
(74) *Attorney, Agent, or Firm*—Sughrue Mion, PLLC

(57) ABSTRACT

A pneumatically powered nail gun having a duster mechanism which is also pneumatically powered with the same pneumatic source. The nail gun includes a main body having a lower end and defines therein a compressed air chamber. A cylinder piston arrangement is disposed in the main body, and the compressed air is selectively applied to the piston for moving a driver blade connected to the piston to drive a nail. The duster mechanism includes a duster nozzle provided at the main body for ejecting a compressed air therethrough. A pressure release valve is disposed at an air passage extending between the duster nozzle and the compressed air chamber for selectively shutting off a fluid communication therebetween. A pressure regulating section is disposed at the air passage for providing a compressed air passing through the duster nozzle at a pressure lower than that in the compressed air chamber.

11 Claims, 6 Drawing Sheets

NAIL GUN PROVIDED WITH DUSTER FUNCTION

BACKGROUND OF THE INVENTION

The present invention relates to a nail gun provided with an air duster which ejects compressed air for removing dust, wood chips and wood shavings out of an intended nail driving area.

Laid open Japanese Patent Application publication No. Hei 10-109280 discloses, as shown in FIGS. 1 and 2, a nail gun 601 having nail driving function A and duster function B. The nail gun 601 includes a main housing 602 and a handle 602A. In the main housing 602 a compressed air chamber 603 is provided, and a cylinder, a piston and a driver blade are disposed. The piston is reciprocally movable in the cylinder by pneumatic pressure applied in the compressed air chamber 603 through a hose 602B, and the driver blade extends from the piston for driving a head of a nail. A safety arm 611 is axially movably provided at a lower portion of the main housing 602. The safety arm 611 has a tip end abuttable on a workpiece. A magazine 620 is also provided at the lower portion of the main housing 602 for accommodating therein nails. A trigger lever 610 is provided near the handle 602A and cooperated with the safety arm 611 for driving the nail into the workpiece upon pulling the trigger lever 610 by the pneumatic pressure applied to the piston from the compressed air chamber 603 after depressing the safety lever 611 onto the workpiece.

An exhaust cover 621 is provided at an upper end of the main housing 602, and an duster nozzle 624 is provided in the exhaust cover 621. The duster nozzle 624 has a nozzle opening with a reduced diameter. A pressure release valve 622 is provided in the exhaust cover 621 for selectively communicating the compressed air chamber 603 with the duster nozzle 624 through first and second air passages 625 and 626. The pressure release valve 622 is connected to an operation button 623 positioned near the handle 602A, so that an operator can push the operation button 623 by a finger while gripping the handle 602A with remaining fingers of the same hand. For cleaning a surface of the workpiece before nail driving operation, the duster nozzle 624 is directed toward the surface and the operation button 623 is depressed. As a result, a compressed air in the compressed air chamber 603 is ejected out of the duster nozzle 624 to remove the dust, wood chips and wood shavings.

FIG. 2 shows a detail of the pressure release valve 622. The compressed air chamber 603 is communicated with the pressure release valve 622 through the first air passage 625, and the pressure release valve 622 is communicated with the duster nozzle 624 through the second air passage 626. The pressure release valve 622 includes a valve stem 622A axially movable within a valve bush 629. An O-ring 627 is disposed over the valve stem 622A for constantly shutting off air communication between atmosphere and the second air passage 626. Another O-ring 628 is disposed over the valve stem 622A and is seatable on a valve seat section of the valve stem 622A for shutting off air communication between the first and second air passages 625 and 626 when the operation button 623 is not manipulated, and for communicating the first air passage 625 with the second air passage 626 when the operation button is depressed. The O-ring 628 and the valve bush 629 provide a first cylindrical sealing area with a diameter C, and the O-ring 627 and the valve bush 629 provide a second cylindrical sealing area with a diameter D which is smaller than the diameter C. The O-ring 628 defines a pressure release valve chamber 631 in which a compression spring 630 is interposed between an end wall of the valve chamber 631 and an inner end of the valve stem 622A. The valve stem 622A is biased toward the operation button 623 by the biasing force of the compression spring 630 and the pneumatic pressure in the compressed air chamber 603.

For driving the nail, the pneumatic pressure ranging from 0.98 to 2.45 Mpa is required, whereas for duster function the required pneumatic pressure is in a range of from 0.39 to 0.83 Mpa, which is lower than the nail driving pressure. Here, compressed air in the compressed air chamber 603 serves as a power source for driving the nail as well as for ejecting air through the duster nozzle 624. Therefore, the duster pressure must be the same as the nail driving pressure. Because the nail driving pressure cannot be lowered, the duster pressure is undesirably high. When the excessively high pressure is ejected from the nozzle 624, the air can raise up a cloud of dust around the user, or the nail gun 601 can move around uncontrollably due to reaction force, or loud ejection noise may be generated. If the inner diameter of the nozzle opening of the duster nozzle 624 is reduced in an attempt to reduce the pressure level of the ejected air, treble sound is generated at the nozzle opening, or the first O-ring 628 may be disengaged from an annular O-ring groove formed in the outer peripheral surface of the valve stem 622A due to application of high pressure to the first O-ring 628 from the compressed air chamber 603.

SUMMARY OF THE INVENTION

It is an object of the present invention to overcome the above-described problems and to provide an improved nail gun having a duster function providing a pressure level of air ejected out of the duster nozzle sufficiently lower than that of the compressed air chamber.

Another object of the invention is to provide such nail gun capable of lowering ejection sound at the duster nozzle and maintaining the O-ring at its given position without disengagement from the associated O-ring groove.

These and other objects of the present invention will be attained by a pneumatically operated nail gun including a main body defining therein a compressed air chamber, a cylinder, a piston, a driver blade, a control valve, and an improved duster mechanism. The cylinder is fixedly disposed in the main body and provides a cylinder space. The piston is slidably movable in the cylinder between its upper dead center and a lower dead center and divides the cylinder space into an upper cylinder space and a lower cylinder space. The driver blade extends from the piston in the lower cylinder space and is protrudable from a lower end of the main body for striking against a head of the nail in accordance with the movement of the piston toward its lower dead center. The control valve is supported to the main body and selectively introduces a compressed air into the upper cylinder space from the compressed air chamber and discharges the compressed air in the upper cylinder space to an atmosphere. The duster mechanism includes a duster nozzle, an air passage section, a pressure release valve, and a pressure reducing section. The duster nozzle is provided at the main body for ejecting a compressed air therethrough. The air passage section extends between the duster nozzle and the compressed air chamber. The pressure release valve is disposed at the air passage section for selectively shutting off a fluid communication between the compressed air chamber and the duster nozzle. The pressure reducing section is disposed at the air passage section for providing a compressed air passing through the duster nozzle at a pressure lower than that in the compressed air chamber.

DETAILED DESCRIPTION OF THE PREFERRED EMBODIMENTS

Figure 1:
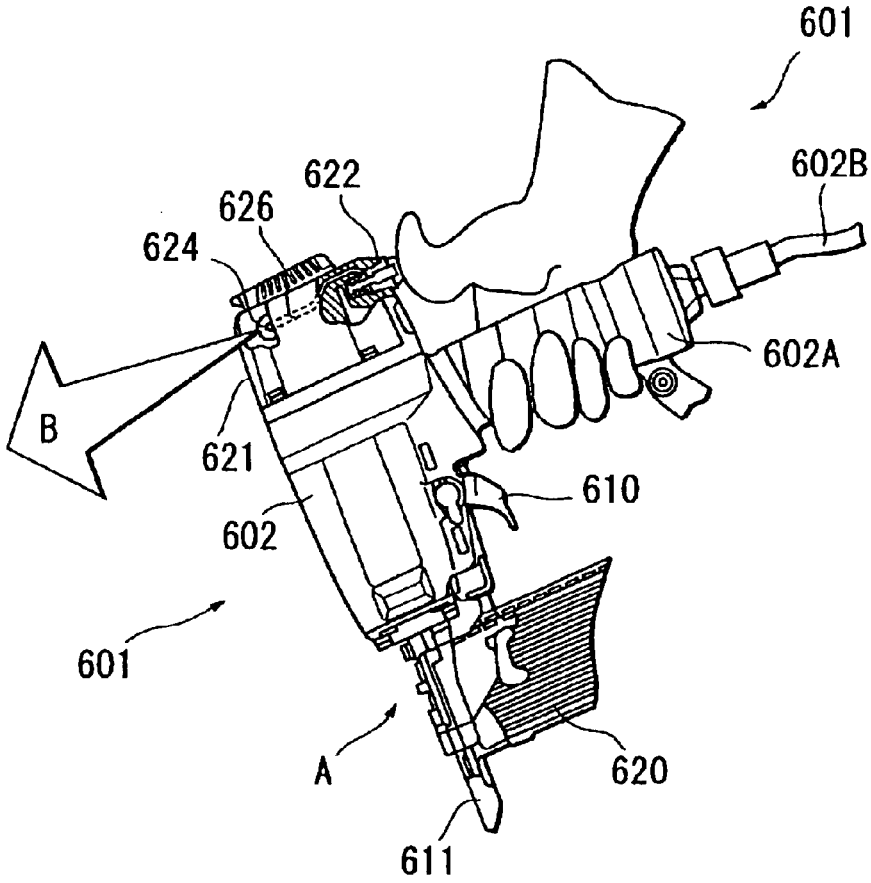
FIG. 1 PRIOR ART
FIG. 1 is a perspective view showing a conventional nail gun provided with duster function.
Figure 2:
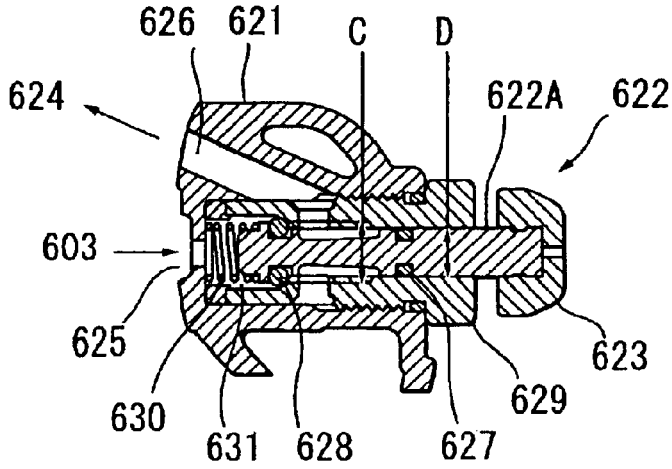
FIG. 2 PRIOR ART
FIG. 2 is a cross-sectional view showing a pressure release valve in the conventional nail gun.
Figure 3:
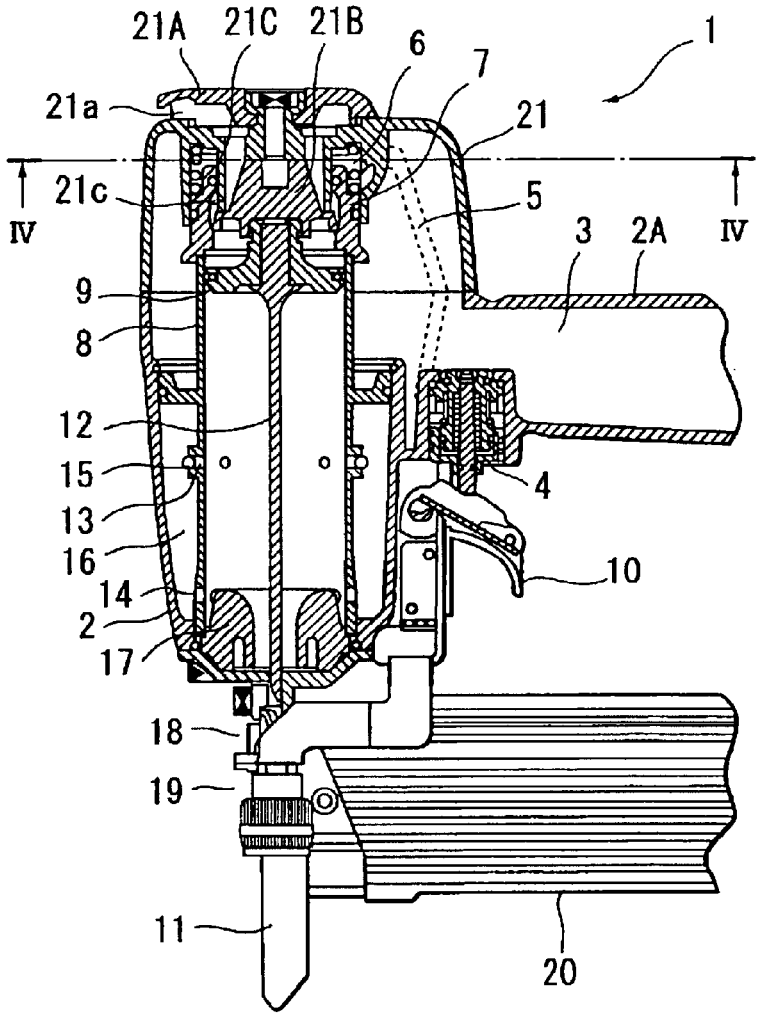
FIG. 3 is a cross-sectional side view showing a nail gun according to a first embodiment of the present invention.

A nail gun according to a first embodiment of the present invention will be described with reference to FIGS. 3 through 6. The nail gun 1 includes a main housing 2, a handle 2A integrally therewith, and an exhaust cover 21 fixed to an upper end of the main housing 2 by bolts. A combination of the main housing 2, the handle 2A and the exhaust cover 21 serves as a main body and defines therein a compressed air chamber 3. An air hose (not shown) is connectable to the handle 2A. The air hose is fluidly connected to a compressor (not shown) so as to supply compressed air into a compressed air chamber 3.

A cylinder 8 is disposed in and fixed to the main housing 2. The cylinder 8 is formed with intermediate vent holes 13 at an axially intermediate position thereof and with lower vent holes 14 at a lower end portion thereof A return air chamber 16 is defined by an inner peripheral surface of the main housing 2 and an outer peripheral surface of the cylinder 8 for accumulating therein compressed air supplied through the intermediate vent holes 13 and the lower vent holes 14 during downward movement of the piston 9. An O-ring 15 having a check valve function is assembled to outlet ends of the intermediate vent holes 13 for allowing compressed air to pass from the cylinder 8 to the return air chamber 16 but preventing the compressed air from passing through the intermediate vent holes 13 from the return air chamber 16 into the cylinder 8.

A piston 9 is slidably and reciprocally movably disposed in the cylinder 8, and a driver blade 12 extends from a lower end surface of the piston 9. The piston 9 divides an internal space of the cylinder 8 into upper cylinder space and a lower cylinder space. A tip end of the driver blade 12 can be protrudable out of the main housing 2 for striking against a head of a nail in accordance with a downward movement of the piston 9. A piston bumper 17 is fixedly positioned within and at the lower end of the cylinder 8 for absorbing or dumping surplus energy of the piston 9 after driving the nail.

A nail injecting section 19 and a magazine 20 are disposed at the lower end of the main housing 2. The nail injecting section 19 includes a tail cover 18 formed with a guide hole for guiding movement of the driver blade 12 and the magazine 20 is adapted for accommodating nails.

A main valve 7 is positioned above the cylinder 8 and is movable toward and away from an upper end of the cylinder 8. A compressed air in the compressed air chamber 3 can be introduced into the cylinder 8 and applied to an upper surface of the piston 9 when the main valve 7 is moved upward, and fluid communication between the compressed air chamber 3 and the upper space of the cylinder 8 is shut off when the main valve 7 is seated on the upper end of the cylinder 8. A valve chamber 6 is defined by the main valve 7 and the exhaust cover 21. When compressed air in the valve chamber 6 is discharged therefrom, the main valve 7 can be moved upwardly to provide the fluid communication between the compressed air chamber 3 and the upper space of the cylinder 8.

An exhaust cap 21A is provided at the exhaust cover 21, and an exhaust port 21*a* is open at the exhaust cap 21A. The upper space of the cylinder 8 can be communicated with an atmosphere through the exhaust port 21*a* when the main valve 7 is moved downwardly so as to discharge compressed air in the upper space of the cylinder to the atmosphere. That is, a conical center member 21B and a sleeve section 21C are disposed in the exhaust cover 21. The sleeve section 21C is formed with a communication hole 21*c*. When the main valve 7 is moved downward, an annular space is provided between the inner surface of the main valve 7 and the lower end of the conical center member 21B so that the compressed air in the upper space of the cylinder 8 can be flowed through the annular space, the communication hole 21*c* and the exhaust port 21*a*.

A trigger lever 10 is provided near the handle 2A and a control valve 4 is disposed to be operated by the manipulation of the trigger lever 10. An air pipe 5 extends between the valve chamber 6 and the control valve 4. The control valve 4 provides a first valve position by the manipulation to the trigger lever 10 to fluidly communicate the valve chamber 6 with the atmosphere through the air pipe 5, and provides a second valve position by non-manipulation to the trigger lever 10 to shut off the fluid communication between the valve chamber 6 and the atmosphere and to fluidly communicates the valve chamber 6 with the compressed air chamber 3 through the air pipe 5. A safety arm 11 is movably supported to the main housing 2 and has one end abutable on a workpiece and another end associated with the trigger lever 10 for preventing manipulation of the trigger lever 10 when the safety arm 11 is not pushed onto the workpiece.

Figure 4:
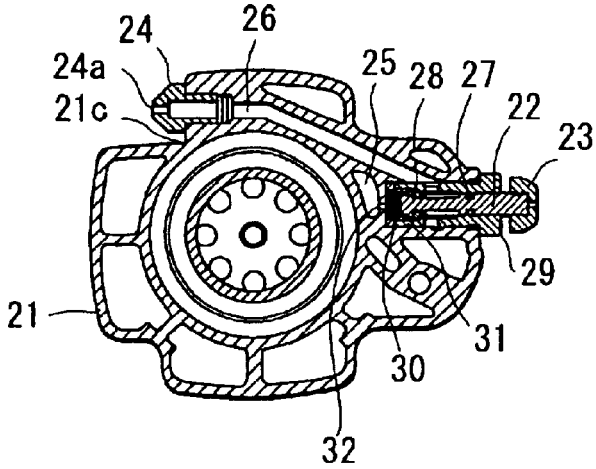
FIG. 4 is a cross-sectional view taken along the line IV—IV of FIG. 3.

Next, a duster arrangement will be described with reference to FIGS. 4 through 6. The duster arrangement is provided in the exhaust cover 21. In the exhaust cover 21, a pressure release valve 22 is provided at a position nearby the handle 2A and fluidly isolated from the control valve 4. The pressure release valve 22 includes a valve stem 22A and an operation button 23 fixed to an outer end of the valve stem 22A. The operation button 23 is provided at a position capable of being accessible by an operator's thumb or forefinger while gripping the handle 2A with remaining fingers of the same hand as shown in FIG. 1. A duster nozzle 24 formed with a nozzle opening 24*a* is provided at an upper recessed portion 21*b* of the exhaust cover 21 for discharging compressed air whose pressure level is lower than that in the compressed air chamber 3 as described later.

A first air passage 25 is formed in the exhaust cover 21 for fluid communication between the compressed air chamber 3 and the pressure release valve 22, and a second air passage 26 is formed in the exhaust cover 21 for fluid communication between the pressure release valve 22 and the duster nozzle 24.

A valve bush 29 is assembled in the exhaust cover 21, and the valve stem 22A is slidably movably disposed with respect to the valve bush 29 in its axial direction. The valve bush 29 has a seat section 29A. The valve stem 22A has an outer large diameter section in sliding contact with the valve bush 29, an intermediate small diameter section, and an inner large diameter section.

A first O-ring 27 is disposed between the valve bush 29 and the outer large diameter section of the valve stem 22A for constantly shutting off air communication between atmosphere and the air passage 26. The outer large diameter section is formed with an annular groove for assembly of the first O-ring 27 thereinto. A second O-ring 28 is disposed over the inner large diameter section of the valve stem 22A, and the second O-ring 28 is adapted to seat on the seat section 29A for shutting off air communication between the first and second air passages 25 and 26 when the operation button 23 is not manipulated, and for communicating the air passage 25 with the air passage 26 when the operation button 23 is depressed. The second O-ring 28 has an outer diameter smaller than an inner diameter of the inner valve bush 29, so that compressed air can pass over the outer peripheral side of the second O-ring 28. The inner large diameter section of the valve stem 22A is formed with an annular groove for assembly of the second O-ring 28 thereinto.

The second O-ring 28 and the seat section 29A of the valve bush 29 define a first cylindrical sealing area with a diameter C, and the first O-ring 27 and the valve bush 29 provide a second cylindrical sealing area with a diameter D which is smaller than the diameter C. Further, the second O-ring 28, the valve bush 29 and an end wall of the exhaust cover 21 define a pressure release valve chamber 31 in which a compression spring 30 is interposed between the wall of the exhaust cover 21 and an inner end of the valve stem 22. In the end wall, a throttle 32 is formed for choking or regulating fluid communication between the first air passage 25 and the pressure release valve chamber 31. The valve stem 22A is biased toward the operation button 23 by the biasing force of the compression spring 30 and by the pneumatic pressure applied to the inner end of the valve stem 22A, the pneumatic pressure being applied from the compressed air chamber 3 through the first air passage 25 and the throttle 32.

Figure 5:
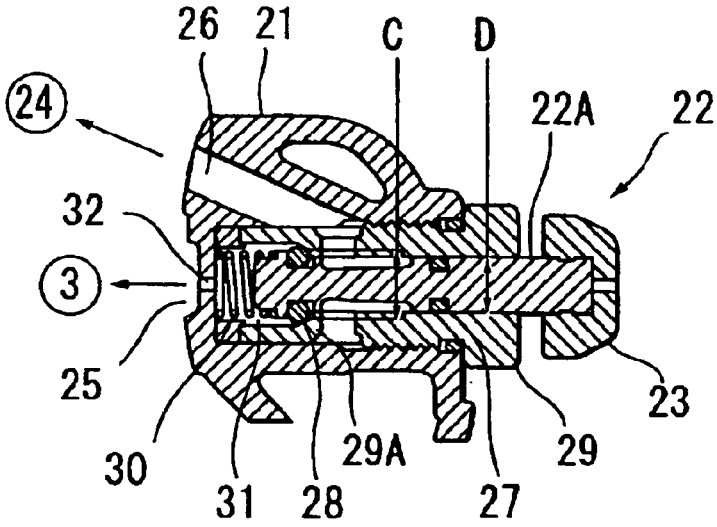
FIG. 5 is a Cross-sectional view showing a pressure release valve in the nail gun according to the first embodiment and showing a non-manipulation state to an operation button.
Figure 6:
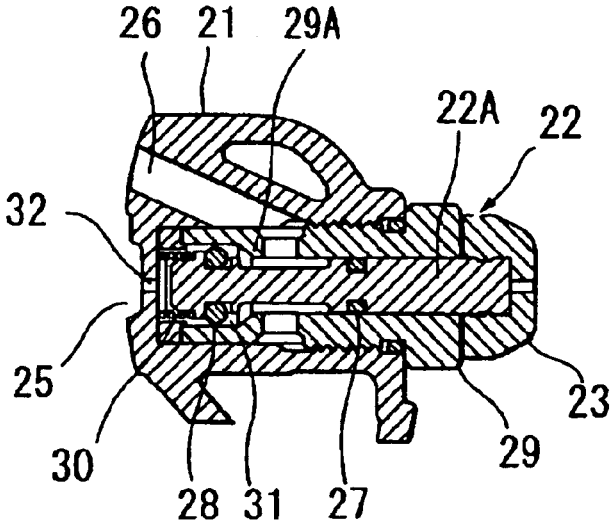
FIG. 6 is a cross-sectional view showing the pressure release valve in the nail gun according to the first embodiment and showing a manipulation state to the operation button.

When the operation button 23 is not depressed, the inner large diameter section of the valve stem 22A is seated on the seat section 29A of the valve bush 29 as shown in FIG. 5 to shut off fluid communication between the first and second air passages 25 aad 26. When the operation button 23 is depressed against the biasing force of the compression spring 30 and the pneumatic pressure, the inner large diameter section of the valve stem 22A is separated from the valve bush 29 and the intermediate small diameter section is aligned with the seat section 29A to provide an annular fluid passage around the small diameter section, thereby providing fluid communication between the first and second air passages 25 and 26.

The throttle 32 has a sufficiently small diameter capable of serving as a pressure reducing section. That is, the throttle 32 has the cross-sectional area so as to provide the highest flow resistance throughout a fluid passage from the first air passage 25 to the duster nozzle 24. Therefore, compressed air passed through the throttle 32 provides a pressure level lower than that in the compressed air chamber 3. Accordingly, the air discharged from the duster nozzle 24 has a pressure lower than that in the compressed air chamber 3. In the illustrated embodiment, cross-sectional areas of the throttle 32, the annular fluid passage around the small diameter section of the valve stem 22A, and the nozzle opening 24*a* are 0.8 $mm^2$, 4.9 $mm^2$, 3.1 $mm^2$, respectively.

In operation, before the trigger lever 10 is manipulated, compressed air in the compressed air chamber 3 is applied to the valve chamber 6 through the control valve 4 and the air pipe 5, so that the main valve 7 is urged to be seated on the upper end of the cylinder 8. Therefore, compressed air in the compressed air chamber 3 cannot be applied to the upper space of the cylinder 8, thereby maintaining the piston 9 at its upper dead center position.

When the tip end of the safety arm 11 is abutted against the workpiece such as a wood, and the nail gun 1 is depressed against the workpiece, the safety arm 11 is moved toward the main housing 2. While maintaining this state, when the trigger lever 10 is pulled, compressed air in the valve chamber 6 is discharged to the atmosphere through the air pipe 5 and the control valve 4, so that the main valve 7 is moved away from the upper end of the cylinder 8. Accordingly, compressed air in the compressed air chamber 3 is introduced into the upper space of the cylinder 8 and is applied to the piston 9. Thus, the piston 9 and the driver blade 12 are rapidly moved toward the workpiece. In this moving the driver blade 12 strikes against the nail positioned within the tail cover 18, so that the nail can be driven into the workpiece.

During movement of the piston 9 toward its lower dead center, the air in the lower space of the cylinder 8 is discharged into the return air chamber 16 through the lower vent holes 14. When the piston 9 is moved past the intermediate vent holes 13, the compressed air in the upper space of the cylinder 8 can also be discharged into the return air chamber 16 through the intermediate vent holes 13. After driving the nail into the workpiece, the piston 9 abuts against the bumper 17, and the bumper 17 is deformed to absorb surplus energy of the piston 9.

When the safety arm 11 is moved away from the workpiece or when the trigger lever 10 is released, the compressed air in the compressed air chamber 3 is introduced into the valve chamber 6 through the air pipe 5 to close the main valve 7, i.e., the main valve 7 is seated on the upper end of the cylinder B. By this movement of the main valve 7, the upper space of the cylinder 8 is communicated with the atmosphere through the exhaust port 21*a*. Therefore, compressed air which has been applied to the upper space of the cylinder 8 is discharged to the atmosphere. Simultaneously, compressed air accumulated in the return air chamber 16 is applied to the lower surface of the piston 9, so that the piston 9 can return to its upper dead center. Thus, a single shot cycle is terminated.

For duster operation, the duster nozzle 24 is oriented toward an intended cleaning spot, and the operation button 23 is depressed against the biasing force of the compression spring 30 and compressed air pressure applied to the valve stem 22A with the operator's finger while the handle 2A is gripped by the remaining fingers of the same hand. As a result, the compressed air in the pressure release valve chamber 31 can be introduced into the second air passage 26. The compressed air is ejected out of the duster nozzle 24 for blowing out the dust and wood chips. Because an internal volume of the pressure release valve chamber 31 is small, only a small amount of highly pressurized air is initially ejected. Thereafter, the compressed air successively introduced into the pressure release valve chamber 31 is subjected to pressure reduction because of the passage through the throttle 32. Thus, the compressed air at a pressure level lower than that in the compressed air chamber 3 is continuously ejected out of the duster nozzle 24.

Consequently, excessive rising up of the dusts and wood chips can be avoided, and the nail gun 1 can be held at a stable position without any accidental movement due to reaction force, thereby enhancing operability. Further, because the throttle 32 provides the highest flow resistance in the flow passage from the compression air chamber 3 to the duster nozzle 24, the duster nozzle discharges the compressed air at a reduced pressure level. Accordingly, the discharge sound at the duster nozzle 24 can be reduced. Moreover, the throttle 32 is positioned immediately upstream of the second O-ring 28. Therefore, the second O-ring 28 can be maintained at its given position with respect to the valve stem 22A without any disassembly from the associated annular O-ring groove of the valve stem 22A, because the reduced pressure is applied to the O-ring 28 as a result of depression of the operation button 23 after the small volume of highly compressed air in the pressure release valve chamber 31 is discharged to the second air passage 26.

Further, even if the cross-sectional area of the second air passage 26 is the same as that of the conventional second air passage, sufficient air expansion occurs in the second air passage 26 to further reduce the air pressure in the second air passage 26 since the cross-sectional area of the throttle 32 is sufficiently smaller than that of the second air passage 26.

Figure 7:
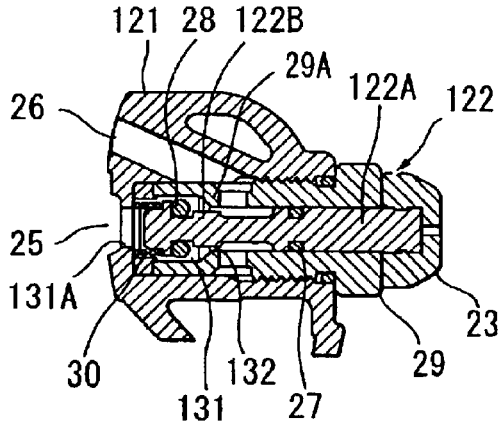
FIG. 7 is a cross-sectional view showing a pressure release valve in a nail gun according to a second embodiment and showing a manipulation state to an operation button.

FIG. 7 shows an essential portion of a pressure reducing arrangement in a nail gun according to a second embodiment of the present invention, wherein like parts and components are designated by the same reference numerals as those shown in FIGS. 3 through 6. Similar to the first embodiment, the second O-ring 28 is seated on the valve seat section 29A. However, a pressure release valve chamber 131 is communicated with the first air passage 25 not with a throttle 32 of the first embodiment, but with a through hole 131*a* with its inner diameter sufficiently greater than that of the throttle 32 of the first embodiment.

For the throttling, an inner large diameter section of a valve stem 122A has a throttling peripheral wall section 122B having a sufficiently long axial length capable of maintaining direct confronting relation between the throttling peripheral wall 122B and an inner peripheral surface of the valve seat section 29A during depressed state of the control button 23. A throttling annular space 132 with a sufficiently small cross-sectional area can be provided between the throttling peripheral wall 122B and the inner peripheral surface of the valve seat section 29A during depressed state of the control button 23. When the compressed air from the first air passage 25 is passed through the annular throttling space 132, the compressed air is subjected to throttling, so that reduced air pressure results in the second air passage 26.

In the second embodiment, upon depression of the operation button 23, the reduced air pressure can be promptly provided because the throttle space 132 is positioned immediately downstream of the second O-ring 28. Further, no pressure variation occurs in the pressure release valve chamber 131 even after the depression of the operation button 23, since the throttling space 132 is positioned immediately downstream of the second O-ring 28. Consequently, no pressure imbalance occurs between immediately upstream and immediately downstream of the second O-ring 28. As a result, the second O-ring 28 can be stably assembled in the associated annular O-ring groove. Further, similar to the first embodiment, air expansion occurs in the second air passage 26 because cross-sectional area of the annular throttling space 132 is far smaller than that of the second air passage 26. As a result, immediate pressure drop occurs in the second air passage 26 to further reduce the air pressure in the second air passage 26.

Figure 8:
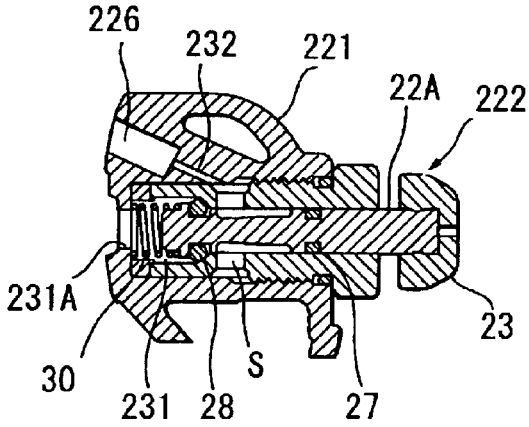
FIG. 8 is a cross-sectional view showing a pressure release valve in a nail gun according to a third embodiment and showing a non-manipulation state to an operation button.

FIG. 8 shows an essential portion of a pressure reducing arrangement in a nail gun according to a third embodiment of the present invention. In a pressure reducing arrangement in the third embodiment, a through-hole 231*a* can have a size the same as that of the through-hole 131*a*. However, the valve stem 22A is the same as that of the first embodiment. For throttling, a throttle portion 232 is provided at a connecting portion between a pressure release valve 222 and a second air passage 226.

After the operation button 23 is depressed, compressed air in the pressure release valve chamber 231 is introduced into a space S immediately upstream of the throttle portion 232. Because the space S has a small internal volume, the inner pressure of the space S is rapidly equal to the pressure in the chamber 231. Therefore, pressure imbalance between upstream and downstream of the second O-ring 28 rapidly disappears for avoiding disengagement of the second O-ring 28 from its associated annular ring groove. After the compressed air passes the throttle portion 232, pressure reduction occurs, thereby providing desirable duster pressure through the duster nozzle 24.

Figure 9:
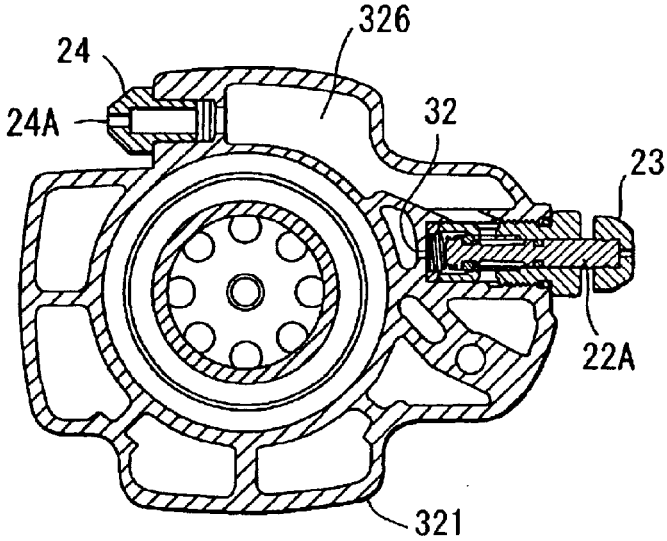
FIG. 9 is a cross-sectional view corresponding to FIG. 4 for showing a nail gun according to a fourth embodiment.

FIG. 9 shows an essential portion of a pressure reducing arrangement in a nail gun according to a fourth embodiment of the present invention. In this embodiment, an exhaust cover 321 provides a second air passage 326 whose internal volume is greater than that of the foregoing embodiments. Therefore, greater air expansion can be provided in the second air passage 326 to accelerate reduction of air pressure in the second air passage 326 after throttling at the throttle 32.

Figure 10:
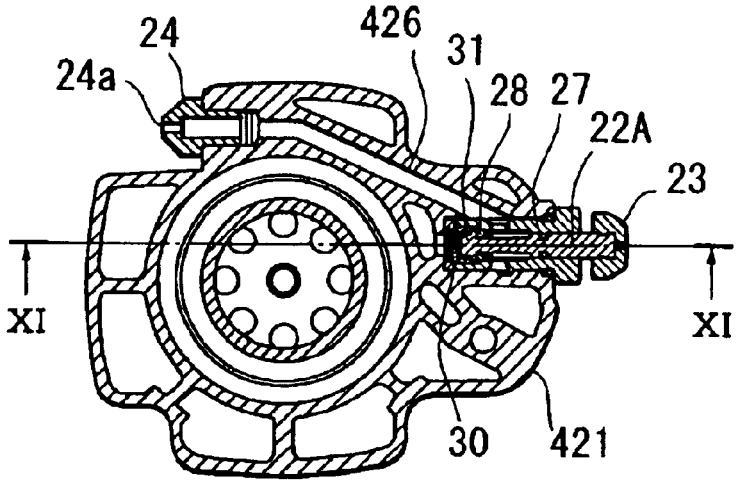
FIG. 10 is a cross-sectional view corresponding to FIGS. 4 and 9 for showing a nail gun according to a fifth embodiment and showing a non-manipulation state to an operation button.
Figure 11:
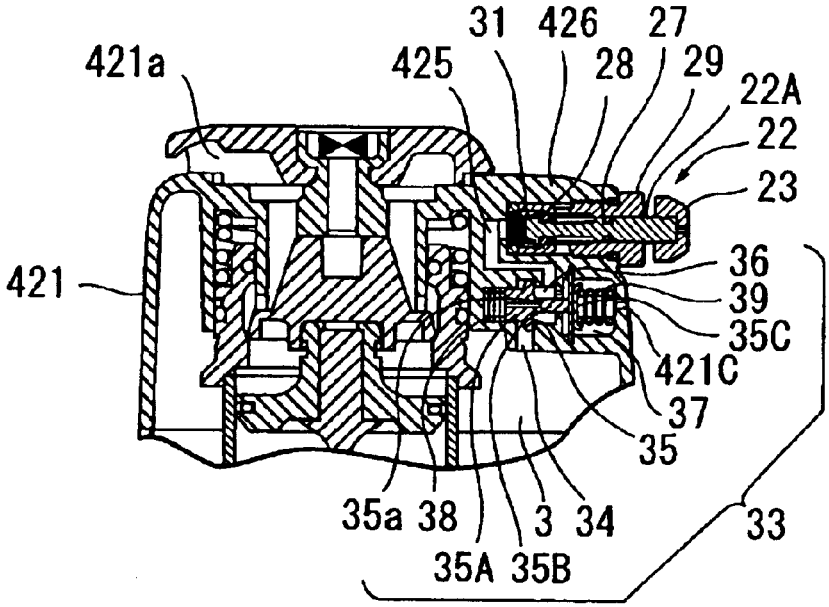
FIG. 11 is a cross-sectional view taken along the line XI—XI of FIG. 10.

A pressure reducing arrangement of a nail gun according to a fifth embodiment of the present invention will be described with reference to FIGS. 10 and 11. In the fifth embodiment, instead of the formation of the throttle 32, 132, 232 or in addition to these throttles, a pressure regulation valve mechanism 33 is provided for providing a compressed air to the duster nozzle 24 at a pressure level lower than that of the compressed air chamber 3.

An exhaust cover 421 is formed with a third air passage 34 for providing fluid communication between the compressed air chamber 3 and the pressure regulation valve mechanism 33. The pressure regulation valve mechanism 33 is in fluid communication with the pressure release valve 22 with a first air passage 425, and the pressure release valve 22 is communicated with the duster nozzle 24 through a second air passage 426.

The pressure regulation valve mechanism 33 includes a valve body 35 having a main valve section 35A for selectively opening and closing the third air passage 34, an intermediate small diameter portion 35B positioned within a valve chamber 36 and a diaphragm section 35C positioned within a diaphragm chamber 37. A first compression spring 38 is disposed in a spring chamber and is interposed between the exhaust cover 421 and one end of the main valve section 35A for urging the main valve section 35A toward its valve closing position in which fluid communication between the third air passage 34 and the valve chamber 36 is shut off. The main valve section 35A is formed with a conduit 35*a* having one end open to the valve chamber 36 and another end open to the first compression spring chamber. The first compression spring chamber is not sufficiently sealed against the third air passage 34, so that the air in the first compression spring chamber can be leaked into the third air passage 34. However, a flanged portion of the main valve section 35A can sufficiently shut off the fluid communication between the valve chamber 36 and the third air passage 34 when the valve body 35 is moved to its closing position.

A second compression spring 39 is interposed between the exhaust cover 421 and the diaphragm section 35C for urging the main valve section 35A toward its valve opening position in which the third air passage 34 is in fluid communication with the first air passage 425 through the valve chamber 36. Biasing force of the second compression spring 39 is greater than that of the first compression spring 38. The diaphragm chamber 37 is divided, by the diaphragm section 35C, into an outer diaphragm chamber in communication with an atmosphere through a hole 421*c* and an inner diaphragm chamber in communication with the valve chamber 36. Atmospheric pressure is always applied to the outer diaphragm chamber through the hole 421*c*.

Prior to operation, the compressed air chamber 3 is communicated with the atmosphere, and the pressure release valve 22 shuts off the fluid communication between the duster nozzle 24 and the first air passage 425. Therefore, the compressed air which has been confined in the first air passage 25 and the valve chamber 36 has been leaked to the compressed air chamber 3 through the conduit 35*a* and the first compression spring chamber. Thus, atmospheric pressure is provided in the valve chamber 36 similar to the outer diaphragm chamber. Therefore, because of the difference in biasing force between the first and second compression springs 38 and 39, the valve body 35 is urged toward the valve opening position of the main valve section 35A.

After introduction of compressed air into the compressed air chamber 3 through the hose, the compressed air in the compressed air chamber 3 is introduced into the valve chamber 36 through the third air passage 34. Therefore, the compressed air is introduced into the first air passage 425 and the pressure release valve chamber 31 of the pressure release mechanism. Therefore, the pressure in the pressure release valve chamber 31, the first air passage 425 and the valve chamber 36 is increased and reaches a predetermined level (0.39 to 0.83 Mpa). Thus, the increased pressure is also introduced into the inner diaphragm chamber and is applied to diaphragm section 35C, so that a combined force of the increased predetermined pressure force and the biasing force of the first compression spring 38 becomes greater than the biasing force of the second compression spring 39, thereby moving the valve body 35 toward its valve closing position of the main valve section 35A.

Then, the operation button 23 of the pressure release mechanism is depressed so that the compressed air confined in the valve chamber 36, the first air passage 425 and the pressure release valve chamber 31 is discharged out of the duster nozzle 24 through the second air passage 426. Because the main valve section 35A closes the third air passage 34, the pneumatic pressure in the valve chamber 36, the first air passage 425, the pressure release valve chamber 31 and the second air passage 426 is gradually lowered. If the pressure level becomes lower than the predetermined pressure level, the biasing force of the second compression spring 39 becomes greater than the combined force of the biasing force of the first compression spring 38 and the inner pressure force in the valve chamber 36. Thus, the valve body 35 is moved to its valve opening position to again allow the valve chamber 36 to be communicated with the third air passage 34. Consequently, the compressed air in the compressed air chamber 3 can again be introduced into the valve chamber 36, and inner pressure of the valve chamber 36 is increased to the predetermined pressure level.

In the above-described reciprocating cycle of the valve body 35, the duster nozzle 24 discharges air at a pressure lower than the pneumatic pressure level of the compressed air chamber 3 as far as the operation button 23 is maintained at its depressed position. Thus, similar to the foregoing embodiments, excessive rising up of the dusts and chips can be avoided, and the nail gun can be held at a stable position without any accidental movement due to reaction force, thereby enhancing operability. If the operator releases the operation button 23, the air communication between the first and second air passages 425 and 426 is shut off.

Figure 12:
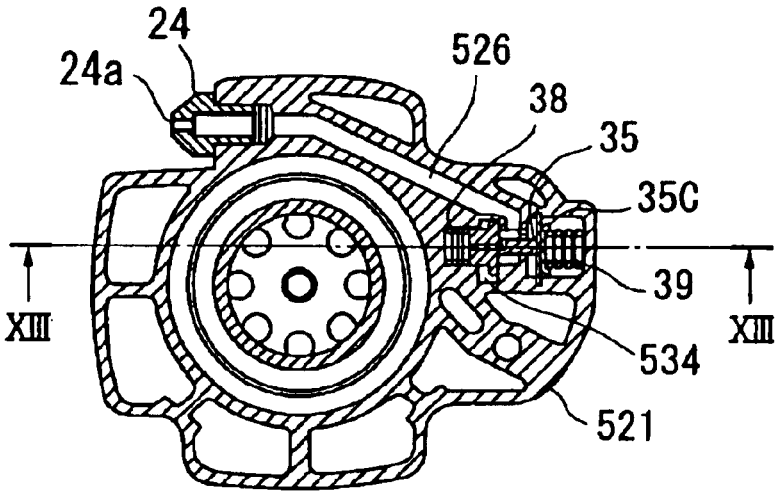
FIG. 12 is a cross-sectional view corresponding to FIGS. 4, 9 and 10 for showing a nail gun according to a sixth embodiment.
Figure 13:
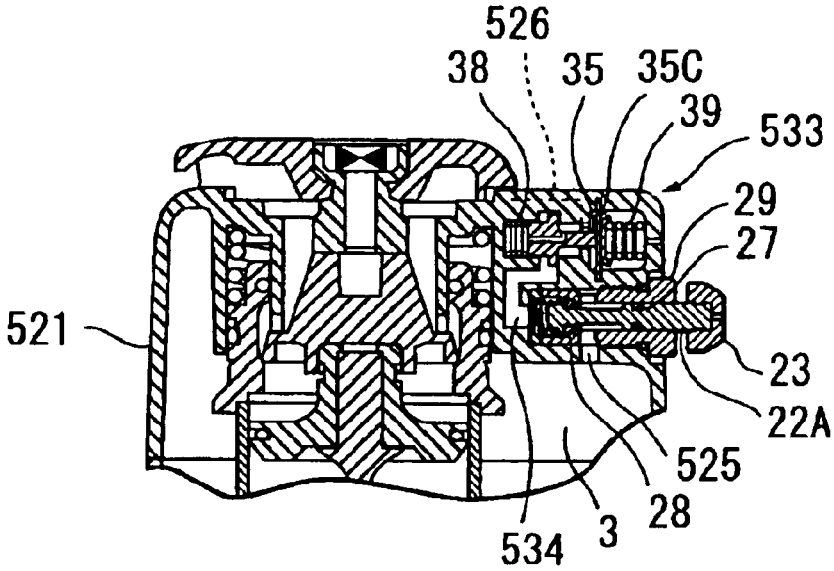
FIG. 13 is a cross-sectional view taken along the line XIII—XIII of FIG. 12 and showing a non-manipulation sate to an operation button.

FIGS. 12 and 13 show an essential portion of a pressure reducing arrangement in a nail gun according to a sixth embodiment of the present invention. In this embodiment, a pressure regulation valve mechanism 533 is positioned downstream of the pressure release valve mechanism. That is, the pressure release valve mechanism is fluidly connected to the compressed air chamber 3 through a passage 525, and the pressure release valve mechanism is fluidly connected to the pressure regulation valve mechanism 533 through a passage 534, and the pressure regulation valve mechanism 533 is fluidly connected to the duster nozzle 24 through a passage 526. Structure of each valve mechanism is the same as each valve mechanism of the fifth embodiment.

While the invention has been described in detail with reference to specific embodiments thereof, it would be apparent to those skilled in the art that various changes and modifications may be made therein without departing from the spirit and scope of the invention.

For example, various throttling arrangements can be provided in the exhaust cover. In other words, the throttling arrangement in the first through fourth embodiments can be selectively combined together. Further, one of the first through forth embodiment can be combined with one of the fifth and sixth embodiment.

What is claimed is:

1. A pneumatically operated nail gun comprising:

a main body having a lower end and defining therein a compressed air chamber;

a cylinder fixedly disposed in the main body and providing a cylinder space;

a piston slidably movable in the cylinder between its upper dead center and a lower dead center and dividing the cylinder space into an upper cylinder space and a lower cylinder space;

a driver blade extending from the piston in the lower cylinder space and protrudable from the lower end of the main body for striking against a head of the nail in accordance with the movement of the piston toward its lower dead center;

a control valve supported to the main body and selectively introducing a compressed air into the upper cylinder space from the compressed air chamber and discharging the compressed air in the upper cylinder space to an atmosphere; and a duster mechanism comprising:

a duster nozzle provided at the main body for ejecting a compressed air therethrough;

an air passage section extending between the duster nozzle and the compressed air chamber;

a pressure release valve disposed at the air passage section for selectively shutting off a fluid communication between the compressed air chamber and the duster nozzle; and a pressure reducing section disposed at the air passage section for providing a compressed air passing through the duster nozzle at a pressure lower than that in the compressed air chamber.

2. The nail gun as claimed in claim 1, wherein the pressure reducing section comprises a throttle for regulating fluid pressure passing therethrough, the throttle providing the highest flow resistance throughout the air passage section.

3. The nail gun as claimed in claim 2, wherein the air passage section comprises a first air passage section extending between the compressed air chamber and the pressure release valve, and a second air passage section extending between the pressure release valve and the duster nozzle; and wherein the pressure release valve comprises:

a valve bush fixed to the main body and having an inner end portion and a valve seat section;

a valve stem axially movably disposed in the valve bush and having an inner main valve section, an intermediate section whose outer space is communicated with the second air passage section, and an outer slide section in sliding contact with the valve bush with its outer end accessible to an operator;

an O-ring disposed over the inner main valve section and seatable on the valve seat section to provide a valve closing position;

a compression spring disposed in the inner end portion of the valve bush for urging the main valve section to its valve closing position.

4. The nail gun as claimed in claim 3, wherein the throttle is positioned in direct confrontation with an inner end of the main valve section.

5. The nail gun as claimed in claim 3, wherein the valve seat section has a central circular hole, and wherein the inner main valve section is formed with an annular O-ring groove for assembling therein the O-ring, and wherein the inner main valve section has an outer peripheral portion having a length capable of providing direct confrontation with central circular hole during movement of the inner main valve section toward its valve opening position, the throttle being defined by the outer peripheral portion and the central circular hole of the valve seat section.

6. The nail gun as claimed in claim 3, wherein the throttle is disposed at an intersection between the outer space of the intermediate section of the valve stem and the second air passage section.

7. The nail gun as claimed in claim 3, wherein the second air passage section has an enlarged space section for permitting the compressed air to be expanded therein.

8. The nail gun as claimed in claim 1, wherein the pressure reducing section is positioned adjacent to the pressure release valve.

9. The nail gun as claimed in claim 1, wherein the pressure reducing section comprises a pressure regulation valve mechanism providing an automatic fluid shut off for preventing the compressed air in the compressed air chamber from flowing into a downstream side of the pressure regulation valve mechanism in response to a pressure increase in the downstream side, and providing an automatic fluid introduction for introducing the compressed air into the downstream side in response to a pressure decrease in the downstream side.

10. The nail gun as claimed in claim 9, wherein the pressure regulation valve mechanism is provided between the compressed air chamber and the pressure release valve.

11. The nail gun as claimed in claim 9, wherein the pressure regulation valve mechanism is provided between the pressure release valve and the duster nozzle.

* * * * *